US008353358B2

(12) United States Patent
Wichstrom

(10) Patent No.: US 8,353,358 B2
(45) Date of Patent: Jan. 15, 2013

(54) ARRANGEMENT FOR REDUCING HARMFUL EFFECTS FROM FIRE AND EXPLOSION

(75) Inventor: Finn Wichstrom, Hvalstad (NO)

(73) Assignee: Aker Engineering & Technology AS, Lysaker (NO)

( * ) Notice: Subject to any disclaimer, the term of this patent is extended or adjusted under 35 U.S.C. 154(b) by 589 days.

(21) Appl. No.: 12/440,420

(22) PCT Filed: Sep. 14, 2007

(86) PCT No.: PCT/NO2007/000325

§ 371 (c)(1), (2), (4) Date: Apr. 6, 2010

(87) PCT Pub. No.: WO2008/033036

PCT Pub. Date: Mar. 20, 2008

(65) Prior Publication Data

US 2010/0186972 A1 Jul. 29, 2010

(30) Foreign Application Priority Data

Sep. 14, 2006 (NO) ..... 20064162

(51) Int. Cl.
*A62C 8/00* (2006.01)

(52) U.S. Cl. ..... 169/49; 169/48

(58) Field of Classification Search ..... 169/48, 169/49, 50, 51, 52, 16, 37
See application file for complete search history.

(56) References Cited

U.S. PATENT DOCUMENTS

| | | | | |
|---|---|---|---|---|
| 2,116,879 A | 5/1938 | Day | | |
| 2,340,945 A * | 2/1944 | Ellick | 169/49 | |
| 4,433,733 A * | 2/1984 | Cunningham | 169/49 | |
| 5,154,236 A * | 10/1992 | Eurbin | 169/52 | |
| 5,653,062 A | 8/1997 | Shustov | | |
| 6,155,921 A * | 12/2000 | Evans et al. | 454/184 | |
| 2004/0020666 A1 * | 2/2004 | Catlin | 169/49 | |
| 2006/0207773 A1 * | 9/2006 | Peltz | 169/48 | |

FOREIGN PATENT DOCUMENTS

| | | |
|---|---|---|
| DE | 3702544 A1 | 8/1988 |
| GB | 2388616 A | 11/2003 |
| NO | 168435 | 11/1990 |
| NO | 178116 | 11/1994 |

OTHER PUBLICATIONS

International Search Report, PCT/NO07/000325, dated Nov. 22, 2007, 5 pages.
Norwegian Search Report, 20064162, dated Jun. 13, 2007, 1 page.

* cited by examiner

*Primary Examiner* — Davis Hwu
(74) *Attorney, Agent, or Firm* — Boardman & Clark LLP

(57) ABSTRACT

Arrangement for reducing harmful effects from fire and/or explosion comprising wall elements that are placed in adjacent relationship to one another to form a continuous wall. The element are adapted, when an explosion occurs, to open the area towards the surroundings until the pressure in the area is balanced in relation to the surroundings. Thereafter the elements return to their closed state to enclose the area in relation to the surroundings, preventing air from the surroundings from entering the enclosed area and prevent fire extinguishing fluids from exiting the enclosed area. Preferably, the elements comprises an elastically deformable material so that when the element is forced open, elastic energy is stored in the element to rapidly return the element to the closed state.

13 Claims, 5 Drawing Sheets

Figure 1A:
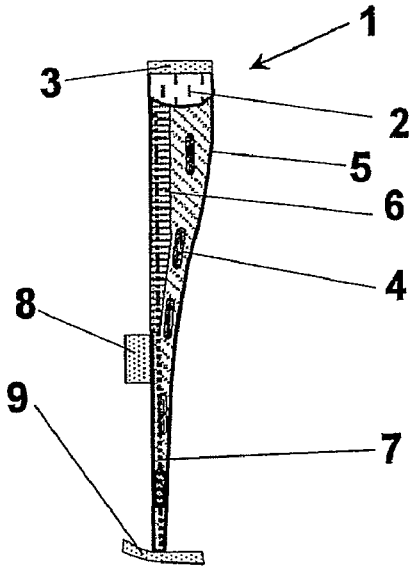

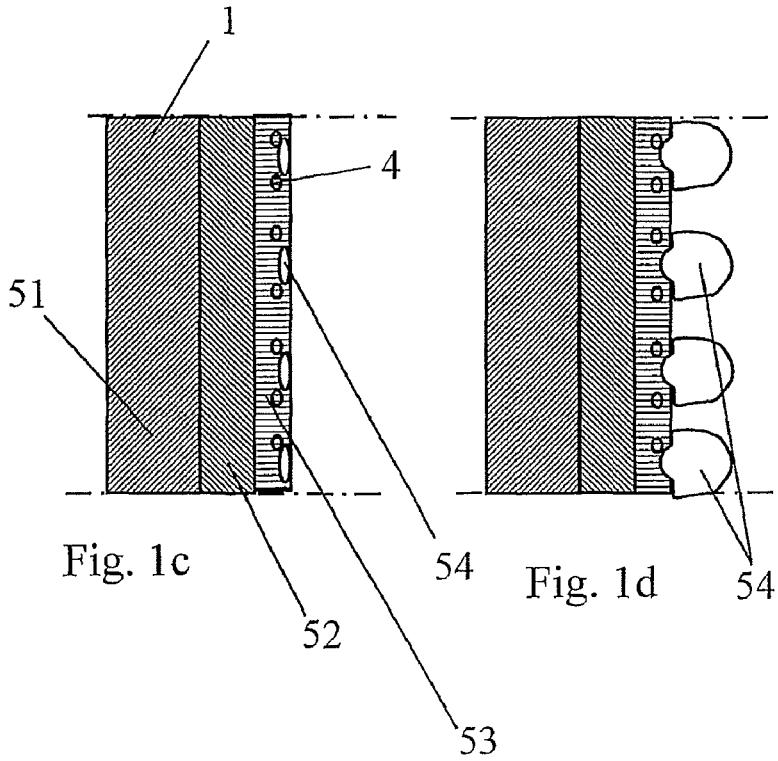
Fig. 1c
Fig. 1d
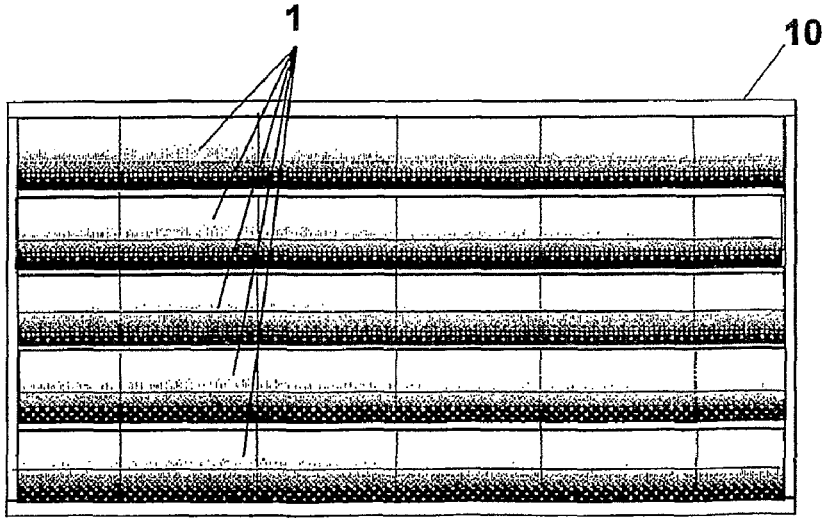
Fig. 2

ARRANGEMENT FOR REDUCING HARMFUL EFFECTS FROM FIRE AND EXPLOSION

This application claims priority to International Application No. PCT/NO2007/000325 filed Sep. 14, 2007, which is incorporated herein by reference in its entirety.

The present invention relates to arrangements for reducing harmful effects from fire and/or explosion, in particular in processing plants, according to claim 1.

Fire and explosion in a processing plant are considered to be one of the severe threats to this type of plants. An explosion in e.g. an oil or gas platform can cause vast losses of human lives and the plat form being set out of function for a very long period. There are also examples of such accidents resulting in that the entire platform must be discarded.

Much effort is therefore made for avoiding the occurrence of such accidents and to limit the extent of damage. Some of the most important means in that matter are good safety and maintenance routines and a fire extinguishing system with large capacity.

Even if safety and maintenance routines are thoroughly followed, one can still not avoid the occurrence of an explosion or a fire, from time to time. Explosion and fire are often connected in that a fire often follows an explosion. The fire is what causes most of the overall material damages. The explosion exposes the lives of the ones that are in the direct vicinity of the explosion site, but the succeeding fire exposes the lives of everyone on the platform, for instance.

Hence, much attention is directed on putting out fires as quickly as possible. The keyword in this context is water-water in large quantities. However, large quantities of water require large pumping capacity. Thus, oil and gas platforms are provided with large fire pumps and a corresponding power supply and water conduits. All this equipment is very costly, occupies space and contributes to much weight.

Another factor which has arisen lately is offshore survey and production operation in arctic regions. Here the temperature will be several tens of minus degrees in large parts of the year. With the wind, the effective temperature will quickly sink down to minus 50° C. If a fire breaks out and is to be put out with large amounts of water under such conditions, this will result in that the water freezes to large amounts of ice on the production equipment. First, this ice will be difficult to remove, and it can contribute to so much weight that the platform becomes unstable and even capsizes, at worst.

Therefore it is a strong wish to provide a fire extinguishing system that can provide just as effective or even more effective extinguishing with less use of water and which is lighter and occupies less space than today's systems.

In connection with arctic survey and production activity, there is also a wish to protect the equipment and the crew from weather, temperature and wind strains. Tests performed on the Russian side of the shelf show that human scan work on the deck for maximum 20 minutes under the extreme conditions present here. Therefore it is a wish to enclose the platform by means of weather louvers. However, such walls will also result in situation where a possible explosion on the platform can destroy pipes, process equipment, and walls. Such destructions will contribute to escalating the accident scenario and increasing the hazard for the personnel.

There have been attempts to device an enclosure that will not, or at least to a lesser degree, be destroyed in an explosion.

One of these attempts is shown in NO 168435, which shows a wall comprising plate panels, which are fixed to a framework at a horizontal beam extending along the middle of the panel. At its upper and lower edge the panel is caught in a groove. If an explosion occurs the panel will slip out of the grooves and bend over the beam. The panel is made of metal (aluminium or steel) and will be permanently deformed during the explosion. Consequently, the panel will not return to its closed position after the pressure of the explosion has receded.

Since the panels remain open after the explosion, large openings in the wall will supply any fire in the aftermath of the explosion with large amounts of air. This will evidently result in a lively fire, which will be hard to extinguish.

Consequently, the prior art panels will probably reduce the effect of the explosion but increase the effect of any fire taking place after the explosion.

Moreover, the panels of the above reference may only be used once. After the explosion the panels will be deformed, probably beyond repair, and will have to be replaced. Even if the fire extinguishing system manages to extinguish the fire before it makes substantial damage, it will take quite some time to replace the panels and put the process plant into working order again.

Another attempt is shown in NO 178116, which shows roof or wall panels that are hingedly coupled to a framework and designed to open during an explosion. The patent, however, is not relating to the opening and possible closing of the panels, but to a security system that prevents falling objects from falling through the roof panels. Consequently, the functioning of the panels during an explosion is poorly explained. What is shown in FIG. 1 is that the panels open during an explosion until they reach a vertical position. It is neither shown nor explained any return of the panels. It is likely that the panels will remain open after the explosion pressure has receded.

The only embodiment shown is panels in the roof. It is stated that panels may also be arranged in the wall, but it is not explained how this will be done. The hinged side of the panel may be oriented any of four different ways. Only if the hinged side is oriented upwards the panel will likely close after the explosion. It is therefore impossible to say if the panels are intended to close or not.

It is also known explosion panels installed on the "Heidrun" platform operated by Statoil ASA in the Norwegian part of the North Sea. These panels are installed in the wall of an enclosure for a process area. The panels are made of metal and are hinged at their upper edge by a torsion hinge that will undergo a plastic deformation when the pressure of an explosion forces the panels to open. Since the hinges are permanently deformed, the panels will not close again to any substantial degree after the explosion pressure has been vented out. Moreover, the hinges and also most likely the panels will have to be replaced after an explosion. One of the reasons for using torsion hinges is that these are cheap and will hold the panels closed against the wind during normal operation.

Consequently, the panels known from "Heidrun" has substantially the same disadvantages as the panels of the above Norwegian patents.

Therefore it is an object of the present invention to provide an enclosure of such explosion exposed areas, which enclosure is not destroyed by an explosion and that will prevent air from entering the enclosure after the explosion pressure has receded. This is obtained with an arrangement where the means for enclosing the area comprise wall elements that are placed in adjacent relationship to one another to form a continuous wall, said element being adapted, when a rapid pressure increase in the area in relation to the surroundings occurs, to open the area towards the surroundings until the pressure in the area is substantially balanced in relation to the surroundings, and that the elements thereafter return to their closed state to enclose the area in relation to the surroundings, preventing air from the surroundings from entering the enclosed area and prevent fire extinguishing fluids from exiting the enclosed area.

Thereby a relief of the pressure in the area is obtained, without destruction of the enclosure, as well as the area being closed again, so that the access to air is limited.

Preferably, the elements comprises an elastically deformable material so that when the element is forced open, elastic energy is stored in the element, the elastic energy being used to rapidly return the element to the closed state. Thereby is obtained panel elements that will not be subject to plastic deformation and hence will return to the closed state in an intact condition.

Preferably, the area is provided with a fire fighting system. A combination of panels that will close after the explosion pressure is relieved and a fire fighting system for enclosed spaces will be a most effective way of putting out fires that may occur in the aftermath of an explosion.

Preferably, the elements comprise a number of parallel elongated dampers, which are pivotally suspended at their upper, substantially horizontal edge. Thereby, the elements may take advantage of the gravity to ensure rapid closing.

In an alternative embodiment the element is mounted in a frame which is pivotable to open a portion of the wall for venting the enclosed area. Thereby the area may be rapidly vented to bring in fresh air and vent out potentially harmful or unpleasant gasses and vapours.

Preferably, the element is provided with a gasket along the edge thereof. Thereby an airtight seal is ensured.

Preferably, the element is provided with magnets along the edge thereof. Thereby the element will beheld closed against winds and minor pressure changes until the internal pressure of the area exceeds the holding force of the magnets.

Preferably, the element is provided with heat tracing cables. Thereby snow and ice can be removed from the elements.

In a preferred embodiment, the element is provided with inflatable cavities. These cavities can, when inflated, expel snow and ice from the surface of the element.

In a preferred embodiment the arrangement comprises a water fog nozzle with a first ejector, which is adapted to send out relatively large droplets, and a second ejector, which is adapted to send out relatively small droplets, which ejectors are arranged beside each other in such a way that the relatively large droplets entrain the relatively small droplets. This type of fog system is envisaged to have the greatest efficiency, especially if combined with the panel elements of the present invention.

Preferably, the ejectors are arranged in a venturi nozzle, which provides an efficient formation of droplets of the desired size.

In a refined embodiment the arrangement comprises an ionization device at the ejectors, which is adapted to give the water droplets negative charge. Thereby the droplets will have a greater tendency to stay as individual droplets for a longer time.

It has been found that the relatively large droplets should have a diameter in the order of magnitude of 200-1000 μm and that the relatively small droplets should have a diameter in the order of magnitude of 1-10 μm. This will give the greatest efficiency in fire extinguishing.

As mentioned an optimal system for an offshore platform is obtained by combining the enclosure with elements that open with pressure influence and thereafter close, with a water mist system comprising a water mist nozzle with a first ejector, which is adapted to emit relatively large droplets, and a second ejector, which is adapted to emit relatively small droplets, which ejectors are arranged next to each other, in such way that the relatively large droplets entrain the relatively small droplets.

Since the water mist system produces very small droplets, these will easily be blown away, even with weak winds. The water mist system will hence function best in closed spaces. The enclosure according to the invention ensures that the fire area is still enclosed also after an explosion.

The water mist system also provides an effective cooling of inflammable material and suffocation of already burning fires.

Figure 1B:
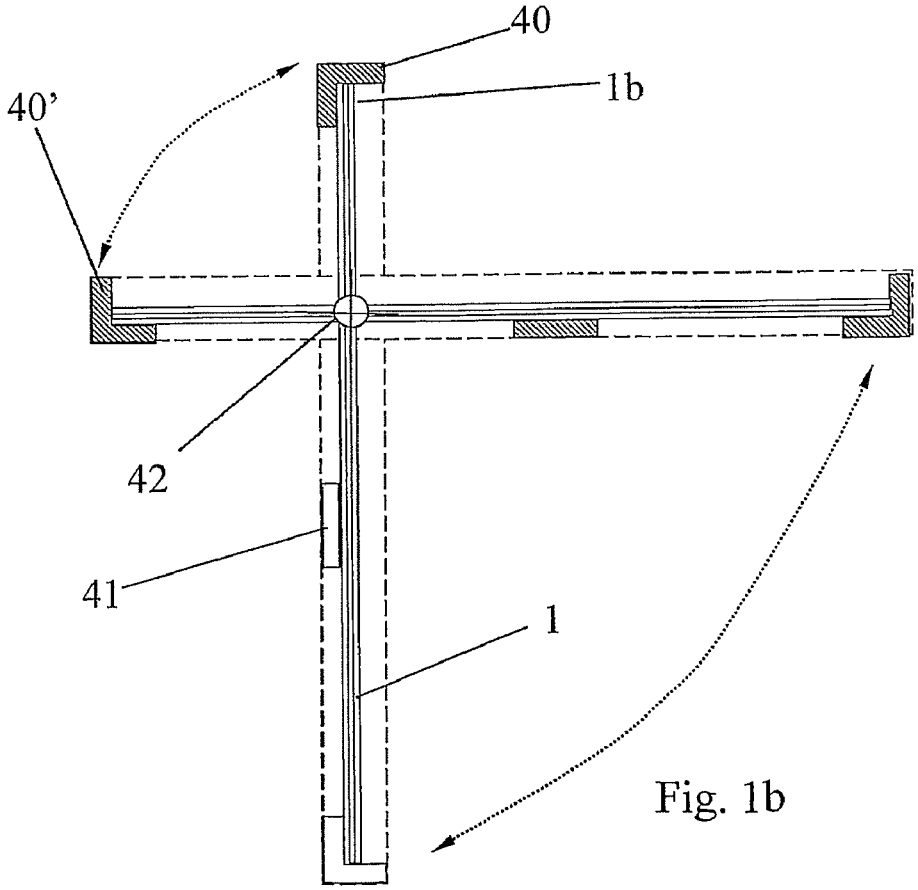
Figure 3:
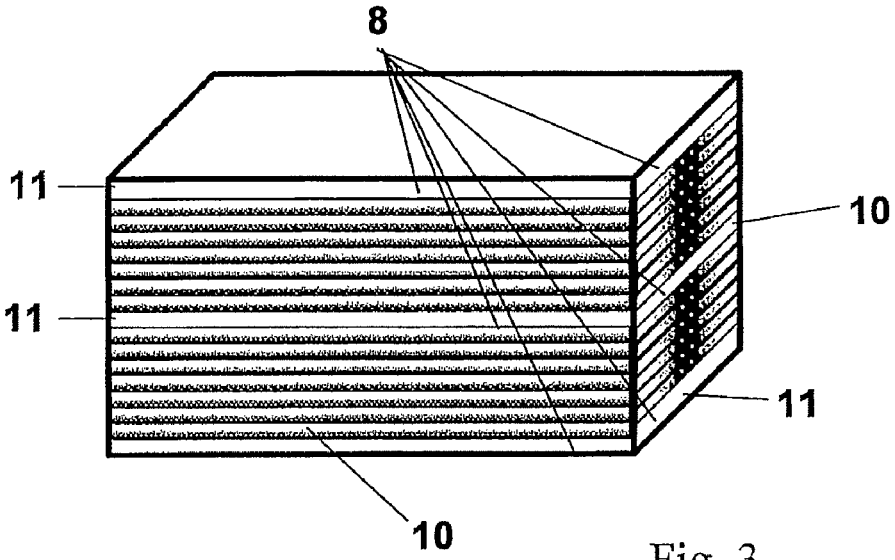
Figure 4:
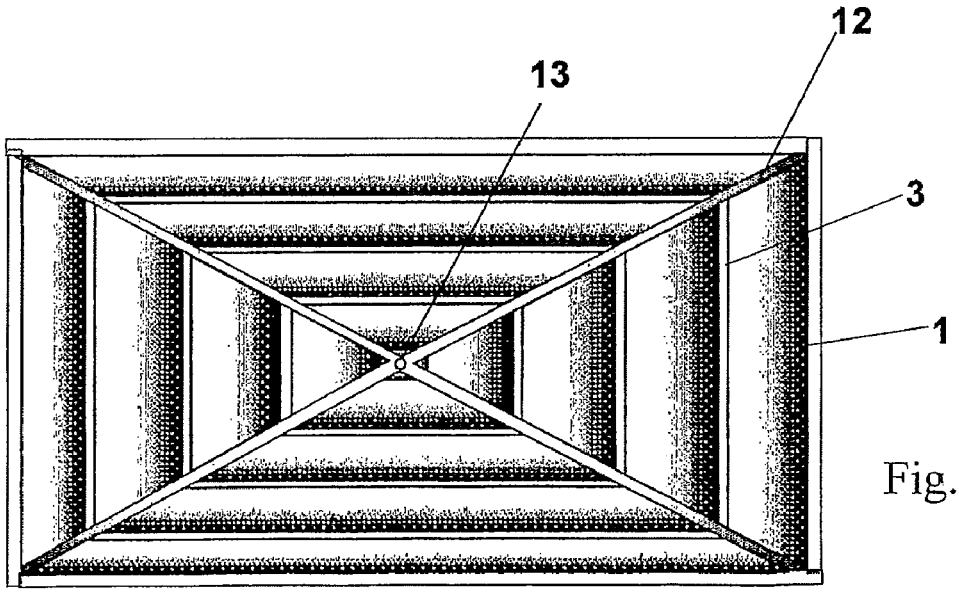
Figure 5:
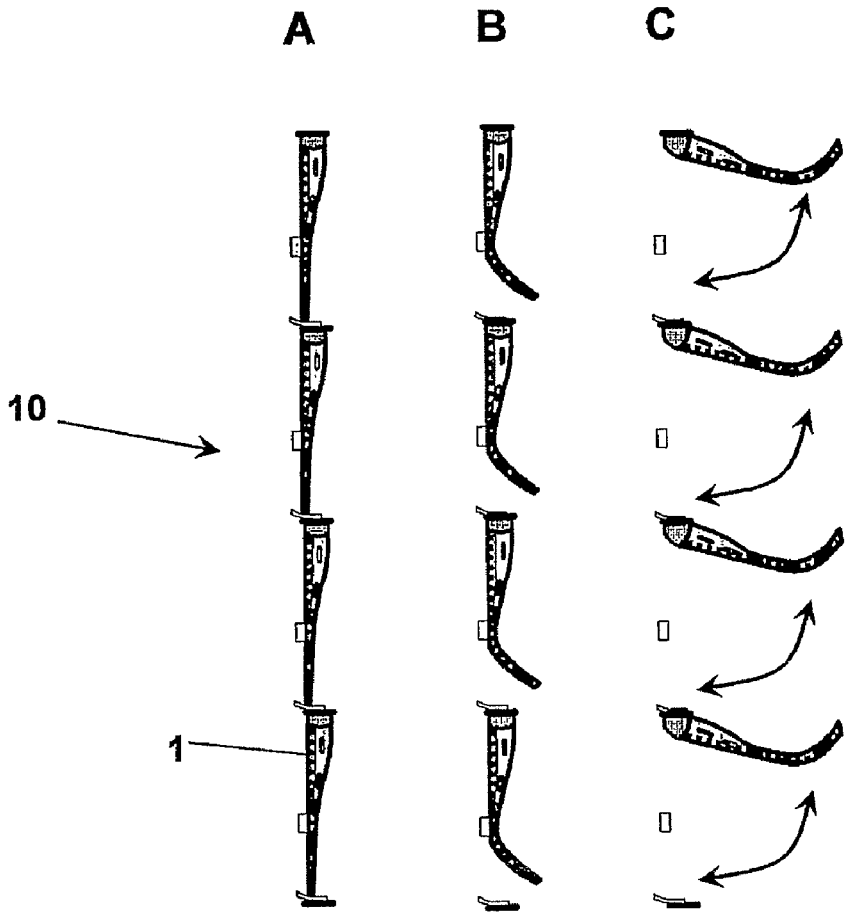
Figure 6:
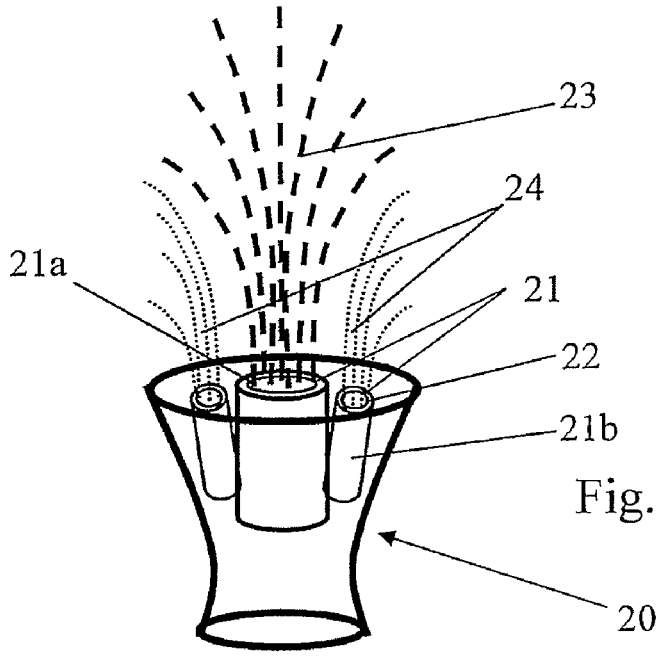
Figure 7:
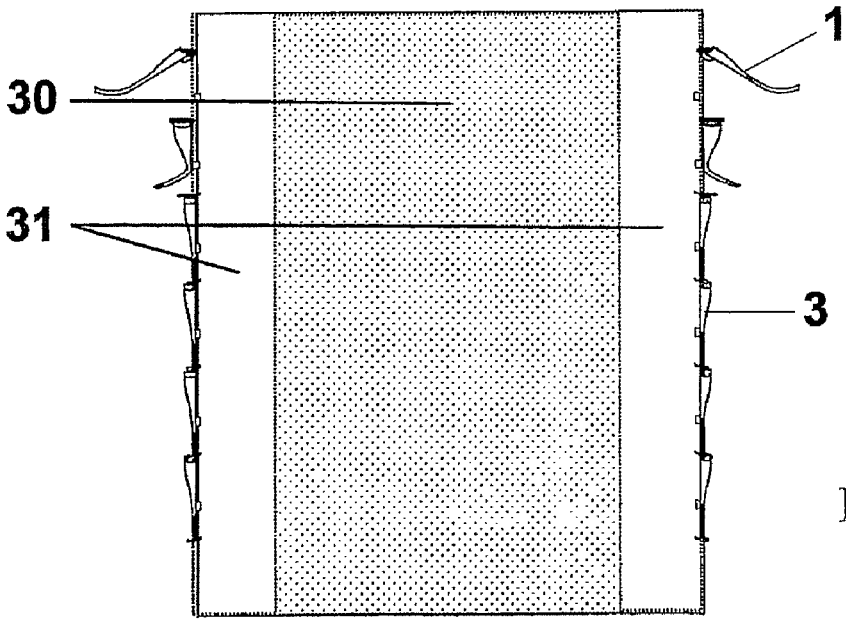

The invention will now be explained closer with reference to the accompanying drawings, in which:

FIG. 1*a* shows a cross section of a damper element according to the present invention in a first embodiment, FIG. 1*b* shows a cross section of a damper element according to the present invention in a second embodiment, FIG. 1*c* shows a detail of the damper element of FIG. 1*a* or 1*b* with cavities in stand-by state, FIG. 1*d* shows a detail of the damper element of FIG. 1*a* or 1*b* with cavities in an inflated state, FIG. 2 shows a front elevation view of a wall assembled of damper elements as shown in FIG. 1*a* or 1*b*, FIG. 3 shows an area enclosed by walls that are assembled of damper elements, according to the invention, FIG. 4 shows an alternative design of a wall or a roof assembled of damper elements, FIG. 5 shows an opening sequence for damper elements during an explosion, FIG. 6 shows, schematically, a water mist nozzle according to the invention, and FIG. 7 shows a cross section of an area enclosed by damper elements and filled with water mist.

Reference is first made to FIG. 1, showing a damper element 1. The damper element 1 is made of a flexible material, such as for instance rubber or a synthetic material similar to rubber. The choice of material will depend on the conditions under which the damper element shall be used. In arctic conditions, a material which is flexible also in cold mist be chosen. The material must be fire retardant and preferably also have heat isolating characteristics.

At its upper edge, the damper element 1 is provided with a flexible hinge 2. In the figure, this hinge is bolted to a foundation 3, which is or will be apart of a frame structure. The damper element can also be provided with heat tracing cables 4, which can be used if condensation and possible icing on the inside is a problem. The effect of this will be explained in detail further below. These heat tracing cables 4 can also contribute for heating the enclosed space within, so that the crew can work under favourable temperature conditions. The heat tracing cables 4 also ensure that the damper elements 1 do not get stuck due to freezing.

The damper element 1 consists of two main parts: an upper part 5 and a lower part 7. The upper part 5 is provided with a plate 6, threads or bands of a relatively heavy material, which causes the damper element to fall back rapidly when the pressure in the enclosed area is balanced with respect to the surroundings. This plate 6 also counteract flickering of the damper element caused by wind.

The lower part 7 is thinner than the upper part 5, and more flexible. Thereby, a break line is defined in the junction between the upper part 5 and the lower part 7. Between the upper and the lower part there is a foundation 8, which also is or will be apart of a frame structure. At the lower edge of the damper element 1 there is also a foundation 9, which in the same manner as the foundations 3 and 8, is or will be a part of a frame structure.

Each of the damper elements 1 is suspended in a frame structure via a respective foundation 3. In this way, several damper elements 1 form a wall 10, as shown in FIG. 2. In the frame structure, the above-lying foundation 9 and below-lying foundation 3 can be integrated parts. Alternatively, the below-lying foundation 3 can lie within the above-lying foundation 9, so that a small overlap results between adjacent damper elements 1. However, t is preferred that slits for ventilation are made between at least some of the damper elements 1. The damper elements preferably expand over the entire length of the wall, but can also be divided in sections. An appropriate size of the damper elements is a height of about 1 meter and a length of about 3 meters.

FIG. 1*b* shows an alternative embodiment of the damper according to the present invention. In this embodiment the damper element 1 is suspended at its upper end 1*b* in a frame 40. The frame 40 encircles the damper element. The frame also has an abutment 41 about midway along the height of the frame 40. The frame is suspended in a framework (not shown) about by a rotatable shaft 42. An actuator, e.g., a pneumatic motor, may act on the shaft to rotate the frame 40, and thereby also the damper element 1, about the shaft 42 to provide an opening of the wall 10.

The purpose of opening the wall 10 is to achieve a rapid ventilation of the work area enclosed by walls 10. This can be done when the climate allows for it and, of course if there is no fire detected. If a fire is detected when the frames 40 are in an open position (as indicated by reference number 40') the pneumatic motor will be actuated to rapidly close the frame 40. If gas is detected within the area, the frames may also be rotated to an open position to quickly vent out the gas before it ignites or causes any other harm.

The wall 10 may consist entirely of damper elements 1 suspended in a rotatable frame 40 or be a combination of such framed damper elements and damper elements which are suspended as described in connection with FIG. 1*a*.

FIGS. 1*c* and 1*d* show a detail of a damper element 1. It consists of an inner thermal insulation layer 51, which may be a relatively light cellular plastic or other type of light, durable insulation that will bond to a carrier layer 52, which is preferably made of rubber. The insulation layer will ensure that the work area is kept at a comfortable temperature even if extreme cold exist outside of the wall 10. The insulation will also, by maintaining the surplus heat form the processes within the enclosed area" contribute to keep the temperature of the enclosed area above the freezing temperature of the extinguishing fluid used to extinguish a fire within the area. Thereby, there will be less or no need to vent the area with heated air.

The rubber carrier layer 52 is elastic and consists of a rubber composition that maintains its elastic properties at temperatures as low as −60° C. At the outside the damper element 1 has a weather layer 53, which is made of a material, preferably rubber, which has a good durability even if exposed to extreme weather and does not decay by exposure to sunshine. In this layer 53 heat tracing cables 4 may be embedded. The wires 4 maybe distributed over a thin layer and be energized at short intervals, e.g., 10-15 minutes. During this time a thin water film is formed between the dampener element and the ice. It is not expected that this short period of heating will be sufficient to remove the ice. Therefore, the outer layer may in addition have small cavities 54, that are air tight except for a channel (not shown) connecting the cavities to a pneumatic source (not shown). If icing occurs on the dampener, the cavities may be filled with air so that they are inflated. Thereby the ice formed on the dampener will be broken away and leave a dampener surface free from ice behind. A regular schedule of heating by the wires 4 and subsequent inflations of the cavities in the cold season will ensure that the dampener elements are kept substantially free from ice and snow.

The outer layer containing the cavities is especially elastic at the temperature it reaches after the heating by the heat tracing cables. The cavities of all dampener elements may be supplied by the same air pressure source and simultaneously or in sequence. The pressure may be in the order of 7 barg (7 bar above atmospheric pressure).

The materials used for the damper should also be able to withstand the heat of an explosion and a fire until it can be extinguished.

In both the above described embodiments the dampener elements may be provided with a gasket at the edge thereof to prevent rain or snow, or sand in desert areas, from entering the enclosed area. At the edge of the dampener element magnets may also be provided to hold the dampener element against the frame or framework and prevent it from fluttering due to wind. The magnets may be vulcanized into the rubber of the dampener element or may be incorporated into the gasket mentioned above. The strength of the magnets will have to be adapted to the maximal wind loads in the area. FIG. 3 shows an area which is enclosed by four walls 10 that are made of damper elements 1. In the figure is shown dampers 11 for ventilation.

In FIG. 3, the roof over the area is made of totally covering plates. However, it can also be made of damper elements 1. FIG. 4 shows a configuration of damper elements 1 which can be suitable for a roof. However, the configuration in FIG. 4 is also suitable to make walls. Here, a band 12 extends from a centre point 13. Between the bands 12 extends a foundation 3, to which the damper elements 1 are attached with their one side edge. The bands 12 can be made of a brittle material which cracks if the explosion pressure becomes so high that the damper elements 1 cannot let out this pressure alone. Thus, the centre point 13 can have a weak zone where the cracking of the bands can start.

The mode of operation of the damper elements I will now be explained with reference to FIG. 5. In the figure, a normal state of a wall 10 made of damper elements is shown on the left, below the letter A. The damper elements 1 hang directly above one another and form a substantially continuous vertical wall.

When an explosion starts, the pressure inside the enclosed area will increase very quickly. Hence, it is important that the damper elements 1 begin to open before the pressure has become so large that the walls 10 cannot withstand it. The reaction time needed by the damper elements depends on the mass in the damper element which is activated and thus the reaction moment setup by the damper element. The lower part 7 of the damper element 1 in the embodiment of FIG. 1*a* has the least mass and will react first at a predefined pressure in the room. In this way, the lower, light and flexible part 7 of the damper element I will start to swing outwardly as shown in the middle of FIG. 5, below the letter B. Hence, a part of the pressure in the area is relieved and the pressure build-up in the area is delayed. As the pressure in the area increases further, the upper part 5 of the damper elements 1 will follow and swing outwardly as shown to the right in FIG. 5, below the letter C. Hence, a larger part of the pressure in the area will be relieved.

Test have shown that it is possible to achieve an opening time from closed to fully open position of the dampener as low as 0.15 seconds. The tests have also shown that when the dampener element has reached it fully open position it has been supplied with a large amount of elastic energy that is sufficient to bring the dampener back to its closed position approximately as quickly as the opening. This means that the dampener will stay open just as long it takes for the explosion pressure to vent out from the enclosed area. This also means that there is little possibility for air (and hence oxygen) from outside of the area to enter through the dampeners.

The damper elements 1 are adapted to be able to let out the pressure from an explosion so quickly and effectively that the pressure in the area doesn't exceed the pressure that the walls can endure. However, it is not desirable that the dampers open before the pressure has reached a predefined value. This is to avoid flickering resulting from wind influence. In the embodiment of FIG. 1*a* the plate 6 in the upper part 5 of the damper element ensures to give this part of the damper sufficient moment of inertia so that the predefined pressure is obtained before the upper part 5 swings outwardly.

An expansion lasts in the order of 100 to 150 milliseconds. Thus, during this time the lower part 7 will first swing outwardly and thereafter the upper part 5. When the explosion has ended, the damper elements 1 will swing back to its abutment against the foundations 8 and 9. It shall be noted that with smaller explosions, it may happen that only the lower part 7 of the damper element 1 will come into function.

A hydrocarbon fire in a processing plant can be very intense and the temperature in the burning area can quickly reach 1300 1500° C. If the material damages shall be reduced to a minimum, it is important to control or extinguish the fire as quickly as possible. Because the damper elements 1 swing back and again enclose the area after an explosion, the feed air to a succeeding fire will be reduced and larger fires within the processing room will be under-ventilated. That means that the supply of air is less than what the fire needs for a complete burning.

Tests that have been performed with a single damper element made of a rubber sheet shows that the damper will open fully during the about 0.15 seconds of the pressure build up of an explosion.

If the damper walls 3 are exposed to an explosion outside the enclosed area, the elastic material in the damper element 1 will function as the canvas of a sail; it will flex and bend along with the frame structure. Thereby the carrying frame structure in the wall (which preferably is of steel) will experience a completely different load than if the dampers had been of metal.

FIG. 6 schematically shows a water mist nozzle according to the present invention. It comprises a venturi funnel 20 and a set of ejectors 21. The ejectors 21 are adapted to spray out water droplets for making a water mist. Around every ejector lies a negatively charged ring 22 that applies an electric current through the water droplets that leave the ejector and thereby charge these electrically, preferably negatively. Attempts to ionize water droplets in smaller scale have been conducted.

At the nozzle, according to the present invention there are arranged ejectors of two different types; a first ejector type 21*a*, which sprays out water droplets 23 with a relatively large size, i.e. with a diameter in the order of magnitude of 200-1000 μm, and a ejector type 21*b*, which sprays out water droplets 24 with a relatively small size, i.e. with a diameter in the order of magnitude of 1-10 μm.

Water droplets with small size arc the most efficient when it comes to extinguishing fires and cool down equipment because they have a much larger surface in relation to the volume. 16 millions water droplets with a size of 1 μm corresponds to the volume of a droplet with a diameter of 250 μm, and the sum of these small droplets has a surface which is 250 times as large as the surface of one water droplet of 250 μm. Hence, the contact surface against the fire and the warm surroundings are much larger. The disadvantage of the small droplets is that they cannot be thrown very far. The mist that is made by these droplets will move very slowly out into the fire area. During this time, the water droplets will seek together into larger droplets and thereby become less effective. Hence, ejectors yielding such small droplets have been used in small rooms. It has also been necessary to arrange many ejectors spread out in the room. Such an arrangement is very inconvenient and involves high installation costs in a processing plant.

According to the present invention, the large droplets 23, which can be thrown relatively far, are used to entrain the small droplets 24 by the formation of a negative pressure behind each of the larger droplets. The venturi funnel 20 also sees to that a forceful air stream arises, which drags with it the large and the small droplets 23 and 24. Thereby a negative pressure is created at the mouth of the venture funnel, which pulls the small droplets 24 with it, away from the nozzle. The small droplets 24 are thus thrown substantially as far as the large droplets 23.

A fire is generally positively charged and all metal surfaces will be grounded. By giving the water droplets a negative charge, they will seek towards the fire and all metal surfaces. Since the droplets (both the large and the small ones) are negatively charged, they will have a tendency to repel mutually. The small droplets will therefore to small extent merge into bigger droplets or merge with the large droplets.

In this way one will be able to fog the whole fire-exposed area without it being necessary to use a very large number of nozzles. This is of substantial importance for operation and maintenance of the processing plant in general, also because the nozzles can be placed outside those areas which are necessary for doing inspection and maintenance of processing equipment and pipes. FIG. 7 shows a schematic cross section through an enclosed processing area.

A purpose with the present invention is to reduce the amount of leaked hydrocarbons that incinerates, and to the outmost consequence that all hydrocarbons remain not incinerated after an extinguishing process having been performed. However, the amount of hydrocarbons that leak out in the processing room is governed by the size of the processing containers, the placement of sectioning valves and the decompression rate for the process containing hydrocarbons. It will therefore in most cases be large amounts of not incinerated hydrocarbons that leak out in the processing room after the fire has been put out.

When the pressure rises in the room due to the amount of hydrocarbons that leaks out, the damper elements 1 will eventually open and release these gases. Not incinerated hydrocarbons outside the processing room will in most cases represent a substantial safety risk. The reason for this is that if these gases enter other rooms and ignite there, an explosion will occur and the accident may escalate and the accident situation can get out of control.

To avoid such a situation, the invention will with a combination of damper walls 3 and water mist system cause the inner part of the process room 30 to be filled with a water mist which is made for extinguishing fires through cooling and the production of vapour. The droplet size in this area 30 can for instance be 150-250 μm, which gives a relatively efficient cooling. The arrangement of the nozzles will also be in such a way that the distribution of these water droplets will become hanging with a high density in an area in proximity to the walls 3. Hence, they will, as will be described below, go along with combustible gases that are let out through the damper walls 3.

When the pressure rises in the processing room because of leaked out gases, the damper elements 1 will open and let out the hydrocarbons, as shown at the uppermost damper elements 1 in the walls 3. Before the leaked out hydrocarbons can pass the damper elements 1, these gases must through an area 31 close to the inner side of the walls 3. This area is filled with water mist with primarily a smaller droplet size, e.g. 1-10 μm. The mist in this area 31 is sufficiently dense for sufficiently water to be entrained by the hydrocarbon gases that are pressed out to surrounding areas. The effect of gravity on these droplets will not be distinctive, and they may therefore for some time hover on the inner side in relation to the damper wall 3. The effect of the processing area working as a mixing chamber so that the small water droplets (1-10 μm) go with the not incinerated hydrocarbons will be that they prevent the hydrocarbons to cause a harmful explosion if they are mixed with air and come into contact with gases or temperatures over the ignition temperature for the hydrocarbons. At ignition of hydrocarbons in air, a rapid combustion will take place. The distance between the droplets in this area will be small (1-5 μm). The mass of each of these droplets will also be small (approximately 16 millionth of a 250 μm). As a consequence of the combustible in of the combustion gases air, the droplets will very rapidly reach the boiling point. Due to the high density of 1-10 μm droplets, the cooling that this evaporation causes will bring the combustion process below the temperature which is necessary for maintaining the combustion (i.e. the explosion).

The above-mentioned is in contrast to today's opinion that hydrocarbon fires must be isolated and be allowed to be burnt out. Today, one fear that hydrocarbons that escape as an explosive mixture will enter other areas and ignite. However, the risk of this will be substantially reduced when the hydrocarbons are mixed with very small water droplets. Hence, one can allow this mixture to escape in stead of burning out inside the processing area and cause even more destructions here.

The damper elements 1 in the walls 3 can have a varied opening pressure, in that the upper most damper elements 1 open at a lower pressure than the lower damper elements 1. This causes that the leaked out hydrocarbon gases in the processing room will have a tendency to get out of the process room in the areas where the opening pressure of the damper is lowest, i.e. in the upper part of the walls. Here, the path up to free air is shorter and the chances of the hydrocarbons to come into contact with ignition sources are less.

According to the present invention, it is a desire to extinguish or gain control over the fire quickly. That means that leakage, starting fires or explosion risk should be detected as soon as possible, so that the water mist nozzles can begin spraying out water mist preferably before the explosion takes place. Preferably, this will happen as soon as 2 seconds after the leakage or similar has been detected. To obtain this, one will in a first phase get water from small tanks and force the water to the nozzles by means of for instance air or nitrogen under high pressure, so that the air quickly is forced out of the pipes. At the same time as this takes place, fire pumps are started, which pump seawater to the nozzles. The fire pumps use some time to start and deliver the water. The water is supplied from the fire pumps at a lower pressure than when nitrogen is used.

In the first phase it is desirable to use freshwater. If it, before the fire pumps start delivering water, turns out that it was a spurious release, one can stop further ejection before the seawater reaches the nozzles. Thereby one avoids spraying valuable equipment with corrosive seawater and the following cleaning.

If the small freshwater tanks have capacity to deliver water for at least 30 seconds, one will in many cases be able to put out the fire using only freshwater. 30 seconds is normally the time it takes before a fire pump starts to deliver water.

The water demand for extinguishing a fire, according to the present invention, will probably be as little as 10% of that of traditional fire water systems.

According to the present invention it is possible to divide a relatively large processing area in smaller fire cells, which each is surrounded by damper walls 3. One may thereby extinguish a starting fire in one fire cell without influencing the other fire cells. As the damper elements are made of a fire resisting material, they wilt also function as fire barriers between different processing areas in shorter periods (for instance in a period which is sufficient to put out a fire; 15-10 seconds). These processing areas can thus be arranged closer to each other than what would other wise be possible.

The invention claimed is:

1. Arrangement for reducing harmful effects from fire and/or explosion, comprising means for enclosing an area which is exposed to fire and/or explosion, the means for enclosing the area comprising wall elements that are placed in adjacent relationship to one another to form a continuous wall, said elements being adapted, when a rapid pressure increase in the area in relation to the surroundings occurs, to open the area towards the surroundings until the pressure in the area is substantially balanced in relation to the surroundings, wherein the elements thereafter return to their closed state to enclose the area in relation to the surroundings, preventing air from the surroundings from entering the enclosed area and prevent fire extinguishing fluids from exiting the enclosed area, the elements comprise an elastically deformable material, and a number of parallel elongated dampers, which are pivotally suspended at upper, substantially horizontal edge.

2. The arrangement according to claim 1, wherein at least one element is adapted to store energy inflicted when the element is forced open, the energy is being used to rapidly return the element to the closed state.

3. The arrangement according to claim 1, wherein the area is provided with a fire fighting system.

4. The arrangement according to claim 1, wherein the pivot at the upper edge of the damper is a flexible hinge.

5. The arrangement according to claim 1, wherein at least one the element is mounted in a frame which is pivotable to open a portion of the wall for venting the enclosed area.

6. The arrangement according to claim 1, wherein at least one element is provided with a gasket along an edge thereof.

7. The arrangement according to claim 1, wherein at least one element is provided with magnets along an edge thereof.

8. The arrangement according to claim 1, wherein at least one element is provided with heat tracing cables.

9. The arrangement according to claim 1, wherein at least one element is provided with inflatable cavities.

10. The arrangement according to claim 1, further comprising a water fog nozzle with a first ejector, which is adapted to send out relatively large droplets, and a second ejector, which is adapted to send out relatively small droplets, wherein the ejectors are arranged beside each other in such a way that the relatively large droplets entrain the relatively small droplets.

11. The arrangement according to claim 10, wherein the ejectors are arranged in a venturi nozzle.

12. The arrangement according to claim 10, further comprising an ionization device at the ejectors, which is adapted to give the water droplets negative charge.

13. The arrangement according to claim 10, wherein the relatively large droplets have a diameter in the order of magnitude of 200-1000 μm and that the relatively small droplets have a diameter in the order of magnitude of 1-10 μm.

* * * * *

UNITED STATES PATENT AND TRADEMARK OFFICE

CERTIFICATE OF CORRECTION

PATENT NO. : 8,353,358 B2
APPLICATION NO. : 12/440420
DATED : January 15, 2013
INVENTOR(S) : Wichstrom It is certified that error appears in the above-identified patent and that said Letters Patent is hereby corrected as shown below:

In the specifications

In Column 1, Line 14, delete “plat form” and insert -- platform --, therefor.

In Column 1, Line 38, delete “Here” and insert -- Here, --, therefor.

In Column 1, Line 44, delete “First,” and insert -- Firstly, --, therefor.

In Column 1, Line 54, delete “human scan” and insert -- humans can --, therefor.

In Column 3, Line 32, delete “beheld” and insert -- be held --, therefor.

In Column 4, Line 42, delete “mist” and insert -- must --, therefor.

In Column 4, Line 47, delete “apart” and insert -- a part --, therefor.

In Column 4, Line 67, delete “apart” and insert -- a part --, therefor.

In Column 5, Line 11, delete “t” and insert -- it --, therefor.

In Column 5, Line 48, delete “area”” and insert -- area, --, therefor.

In Column 5, Line 60, delete “maybe” and insert -- may be --, therefor.

In Column 6, Line 42, delete “elements I” and insert -- elements 1 --, therefor.

In Column 6, Line 54, delete “setup” and insert -- set up --, therefor.

In Column 6, Line 58, delete “element I” and insert -- element 1 --, therefor.

In Column 6, Line 58, delete “outwardly” and insert -- outwardly, --, therefor.

In Column 7, Line 64, delete “size arc” and insert -- size are --, therefor.

Signed and Sealed this
Thirty-first Day of May, 2016

Michelle K. Lee

Michelle K. Lee
*Director of the United States Patent and Trademark Office*

In the specification

In Column 8, Line 21, delete “venture” and insert -- venturi --, therefor.

In Column 9, Line 27, delete “combustible in of the combustion gases air,” and insert -- combustion of the combustible gases in air, --, therefor.

In Column 9, Line 42, delete “upper most” and insert -- uppermost --, therefor.

In Column 10, Line 17, delete “wilt” and insert -- will --, therefor.

In Column 10, Line 21, delete “other wise” and insert -- otherwise --, therefor.

In the claims

In Column 10, Line 49, in Claim 5, delete “one the element” and insert -- one element --, therefor.